United States Patent [19]

Rütsche et al.

[11] Patent Number: 4,590,865

[45] Date of Patent: May 27, 1986

[54] FURNITURE PIECE WITH A TABLE TOP WHOSE HEIGHT AND/OR ANGLE OF TILT CAN BE ADJUSTED

[75] Inventors: Wendolin Rütsche; Urs Langenegger, both of Rüti, Switzerland

[73] Assignee: Embru-Werke, Mantel & CIA, Rüti, Switzerland

[21] Appl. No.: 568,038

[22] Filed: Jan. 4, 1984

[30] Foreign Application Priority Data

Jan. 18, 1983 [CH] Switzerland ..... 270/83

[51] Int. Cl.[4] ..... A47F 5/12; F16H 27/02; F16M 13/00

[52] U.S. Cl. ..... 108/1; 108/147; 74/89.15; 248/422

[58] Field of Search ..... 108/7, 8, 147, 1, 6, 108/144, 145, 146, 148; 248/422, 412; 74/89.15, 89.16

[56] References Cited

U.S. PATENT DOCUMENTS

| | | | |
|---|---|---|---|
| 1,359,399 | 11/1920 | Lewis | 108/147 |
| 4,515,087 | 5/1985 | Kurrasch | 108/147 |
| 4,516,509 | 5/1985 | Langenegger | 108/147 |

FOREIGN PATENT DOCUMENTS

| | | | |
|---|---|---|---|
| 690103 | 5/1964 | Canada | 108/144 |
| 8112149 | 9/1981 | Fed. Rep. of Germany . | |
| 3114125 | 11/1982 | Fed. Rep. of Germany | 108/144 |
| 3181 | of 1891 | United Kingdom | 108/147 |
| 390214 | 4/1933 | United Kingdom | 108/147 |
| 2133683 | 8/1984 | United Kingdom | 108/144 |

*Primary Examiner*—William E. Lyddane
*Assistant Examiner*—Gerald Anderson
*Attorney, Agent, or Firm*—Kinzer, Plyer, Dorn & McEachran

[57] ABSTRACT

A piece of furniture is equipped with a table top (3) which can be adjusted both in height as well as in its angle of tilt and which is suspended in a stand which consists of two hollow side pieces (1) and a hollow connecting bracket (2). Both the rear as well as the front adjusting mechanisms consist of standardized parts (29, 33, 35, 36, 39, 40) and the same parts can be used in most cases for both mechanisms. This ensures an economical manufacturing process and simplifies storage-keeping. The adjusting mechanisms can be loosely assembled for the most part without any tools, a fact that makes it possible even for unskilled workers to assemble and disassemble the device.

6 Claims, 4 Drawing Figures

FURNITURE PIECE WITH A TABLE TOP WHOSE HEIGHT AND/OR ANGLE OF TILT CAN BE ADJUSTED

BACKGROUND OF THE INVENTION

The subject of this invention is a piece of furniture with a table top whose height and/or angle of tilt can be adjusted, according to the characterizing clause of Patent Claim 1.

A piece of office furniture with an adjustable table top is known in which on the rear edge of the table top, two bolts are arranged whose projecting ends pass through vertical slits of a hollow connecting support. Within the hollow space of the support, there are two vertical adjusting spindles each of which supports a retaining nut which is connected with the bolt in such a way that the rear part of the table is raised or lowered whenever the spindles are twisted.

The adjusting mechanism on the front of the well-known piece of office furniture consists of two adjustable control rods which slide diametrically opposed to each other in their longitudinal direction and which are attached to the front area of the table top; the outer end of each of these control rods projects into one of the side arms of the furniture piece. Each of the side arms has a wedge element which tapers upward and whose wedge surfaces support the control rods. By means of changing the distance of the outer ends of the control rods, a different height level of the table is obtained and/or the angle of tilt is changed.

The production of the two adjusting mechanisms of the well-known piece of office furniture is relatively expensive and mounting them on the table is time-consuming. In addition, a large number of different parts are required, which renders an economic production impossible.

Another well-known piece of furniture with an adjustable table top is one by means of which four vertical spindles, both the height as well as the angle of tilt of the table top can be adjusted. Two of these vertical spindles are connected to the rear edge of the table top and can be moved from below the table by means of a crank mechanism. The lifting device is solidly connected with the table and its construction is relatively complicated. It is not suitable for use in a piece of furniture which is to be assembled in a modular design. Both assembly as well as disassembly of the adjusting device are very time-consuming.

Yet another table is known which can be adjusted in height by means of spindles and a crank mechanism and whose vertical spindles pass through two spur gears which are designed as nuts. The spur gears are driven by means of a joint cogged belt which is moved by a crank and a bevel-gear drive. Neither the adjusting device nor the table as such is suitable for a standardized modular design.

SUMMARY OF THE INVENTION

This invention has the goal of creating a piece of furniture with a table top whose height and/or angle of tilt can be adjusted and which avoids the disadvantages mentioned of the furniture pieces of known design. The adjusting device is to consist of the fewest possible standardized parts which can be easily assembled and disassembled even by relatively unskilled personnel. The adjusting device is to be designed in particular for pieces of furniture which are assembled from prefabricated standardized modules.

The problem is solved as described in the characterization clause of Patent Claim 1.

In order to assemble the adjusting device, the standardized parts are loosely fit into one another or connected with each other without requiring any special tools, a fact which naturally simplifies the assembly and disassembly considerably. It is expedient to provide both an adjusting device for the front as well as one for the rear of the table such that the table top is infinitely adjustable both in height as well as in its angle of tilt. It is highly advantageous in this context if both adjusting devices consist for the most part of the same standardized parts since this ensures an economical manufacture and simple stock-keeping.

The adjusting device for the rear of the table has such a compact design that it can be completely housed within the hollow space of the support which is very narrow and yet leaves enough room to accommodate wirings and other integral parts. Since no parts project or are visible from the outside, the esthetically pleasing appearance of the piece of furniture is not marred. As a result of the fact that the adjusting device is completely enclosed and shielded, there is no bothersome noise when adjusting the table.

The adjusting device on the front of the table is assembled without requiring any tools at all and is inserted into the supporting arms of the side pieces, whereas the rear adjusting device is attached to the hollow bracket by means of a few screws for which only a screw driver is required.

The following paragraphs will describe this invention in greater detail on the basis of practical examples shown in the drawings. It can be seen that

Figure 1:
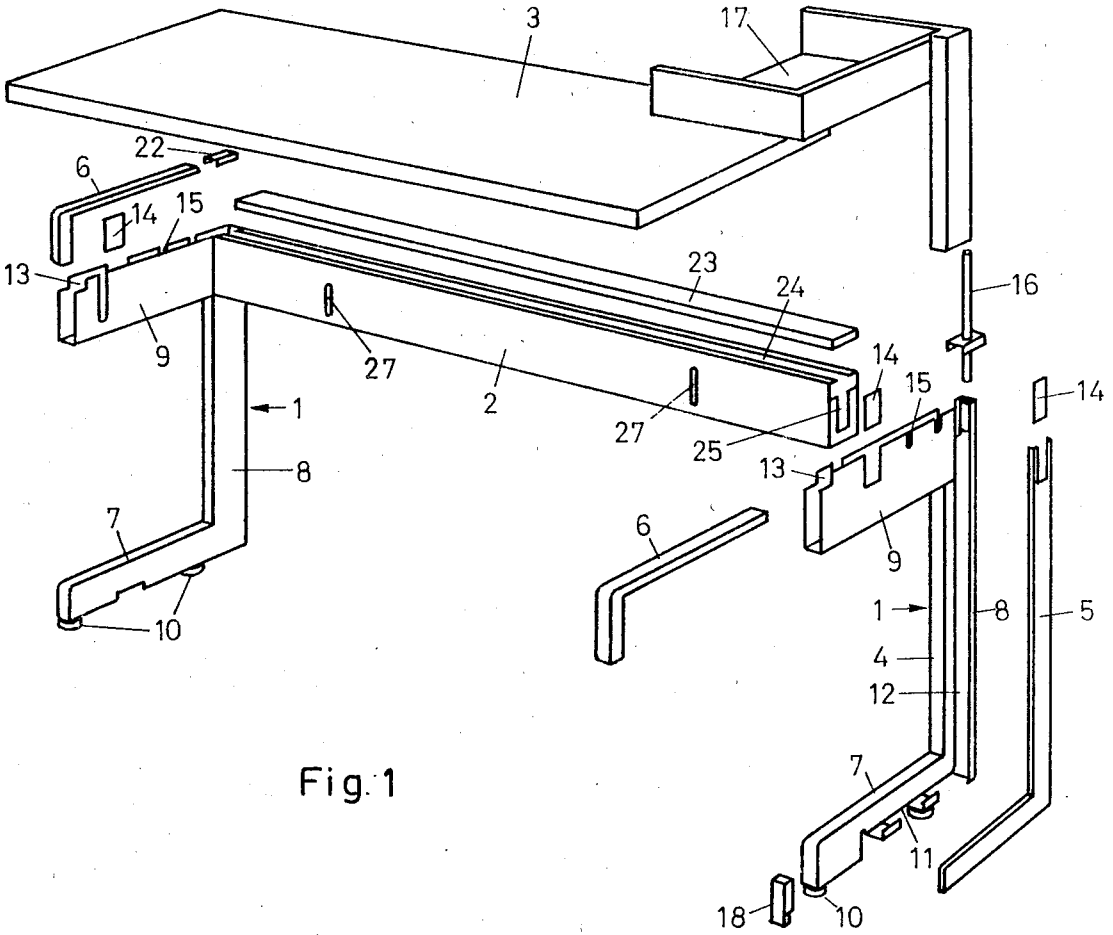
FIG. 1 shows a perspectively exploded view of an office desk in modular design prior to the attachment of the adjusting devices.

The office desk shown in FIG. 1 is one module of an add-on office furniture system of an efficient workplace design. It consists essentially of two side pieces 1, a bracket 2, and a table top 3, with the side parts 1 and the bracket 2 forming a frame into which the table top is inserted.

The side piece 1 is made of sheet metal and exhibits a core element 4 in the shape of a U as well as a lateral and an upper cover 5 and 6, respectively. The core element 4 is designed as a hollow section which is open in part, with the lower leg of the "U" serving as foot 7 of the office desk. The foot extends into a vertical bracing column 8 from which a supporting arm 9 projects. The supporting arm 9 is the second leg of the "U." On the foot 7, carrying bolts 10 of known design and adjustable as to height are attached. The foot 7 has a recess 11 on one side as well as on the bottom, and the bracing column 8 has a vertically extending opening 12 along its side as well. The top of the supporting arm 9 has a slitlike clearance 13 through which its inside becomes accessible from above.

The clearances in the core element 4 make it possible for electrical wires and signalling cables to be threaded through the side piece 1 without loops, i.e., without paying out the ends.

DESCRIPTION OF THE INVENTION

After threading the wires or cables through the side piece, the lateral openings in the foot 7 and in the bracing column 8 can be closed by means of the L-shaped covers made of sheet metal. The cover 5 is connected to the core element 4 through catch pins and locking holders and can therefore be easily pressed onto the core element 4.

A slide 14 which can be inserted at the top into the lateral cover 5 can be removed if other furniture units are to be attached to the side piece. When removing the slide 14, the wires and cables in the inside of the core element 4 become accessible such that these wires and cables can be threaded into the second piece of furniture without any problems. The supporting arm 9 also has a removable slide 14 which serves the same purpose. The additional furniture units are attached to the core element 4 of the side piece 1 by means of attachment screws which are not shown here and which are inserted into the grooves 15 which are open on top. Due to the slide 14, it is possible to embed electrical wires and signalling cables between various furniture units in such a way that they are not visible from the outside.

The bracing column 8 can be closed with a cover plate 22; however, it is also possible to attach clip-on elements such as lamps or a connecting shelf holder with a swivellable shelf on the top of the bracing column 8.

The front of the foot 7 is equipped with a cover plate 18 which can be pressed on.

Figure 3:
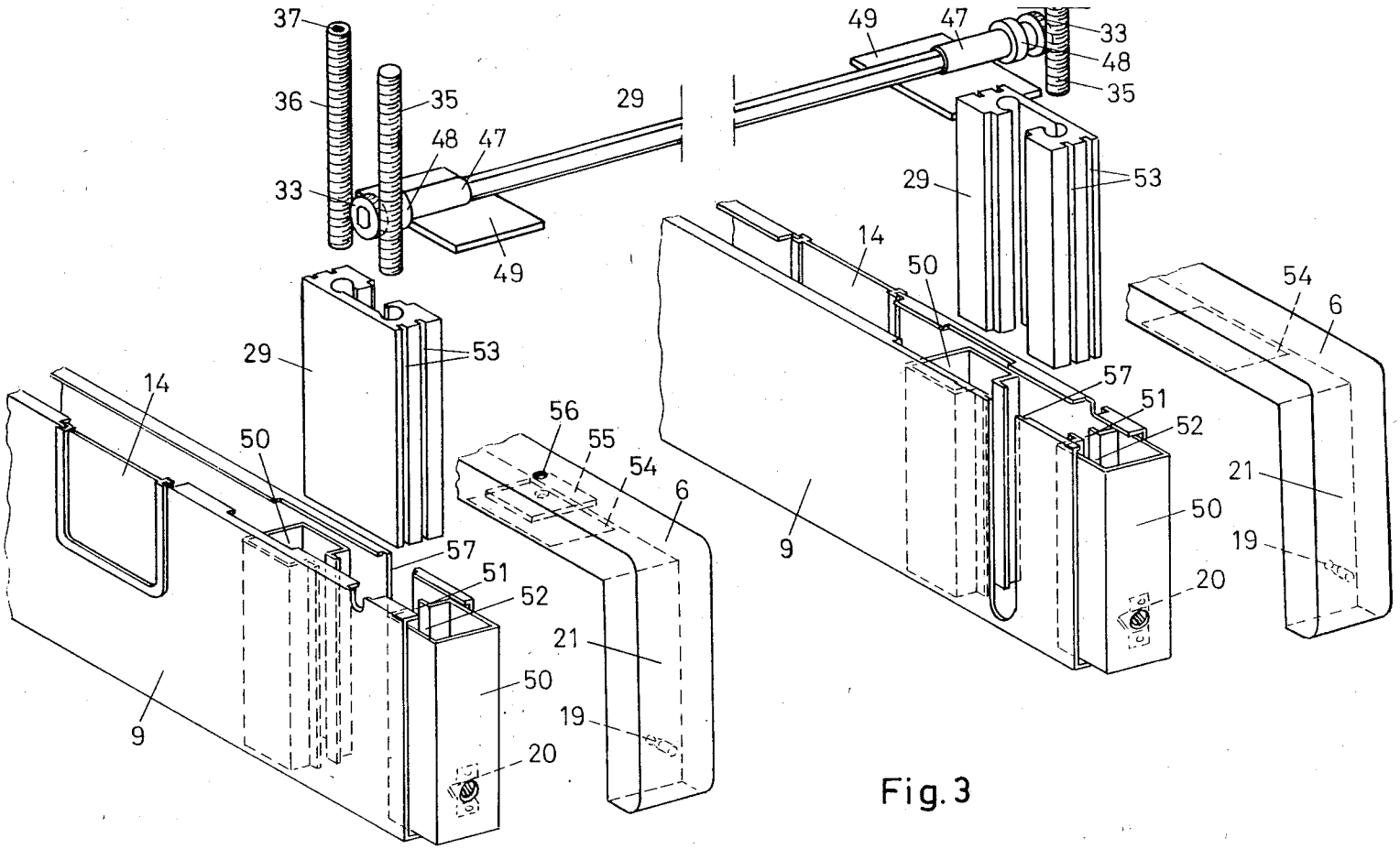
FIG. 3 shows a perspectively exploded view of the adjusting device for the front part of the table.

In order to lock the supporting arm, the upper angular cover 6 is inserted from the front surface of the supporting arm 9 until it latches with its end into a locking device which consists of a catch pin 19 and a spring shackle 20 and which is located on the front surface of the supporting arm (see FIG. 3). The other end of the cover 6 engages the inward pointing shackles of the supporting arm 9 by means of a flap and passes through these shackles. By means of the upper cover 6, the slide 14, the cover plate 22 or a corresponding plug-type unit, as well as possibly available locking screws are secured in the grooves 15.

The bracket 2 connects the two side pieces 1 and also serves as the rear holding device for the table top 3. The bracket 2 is designed in the shape of a U whose inside is hollow throughout and accessible from the outside without interruption and which can be closed by means of a cover 23. The two ends of the bracket 2 are pressed against and screwed to the bracing columns 9 of the side arms 1, with the openings 25 at the ends ensuring access to the inside of the side pieces 1. Adjacent to the rear edge 26 of the table top 3, there is a recess for two vertical slits 27 which are arranged at a certain distance from each other and into which two pins 28 which are attached onto the rear edge of the table top 3 can be inserted.

The table top 3 preferably consists of wood and may be hollow inside.

Figure 2:
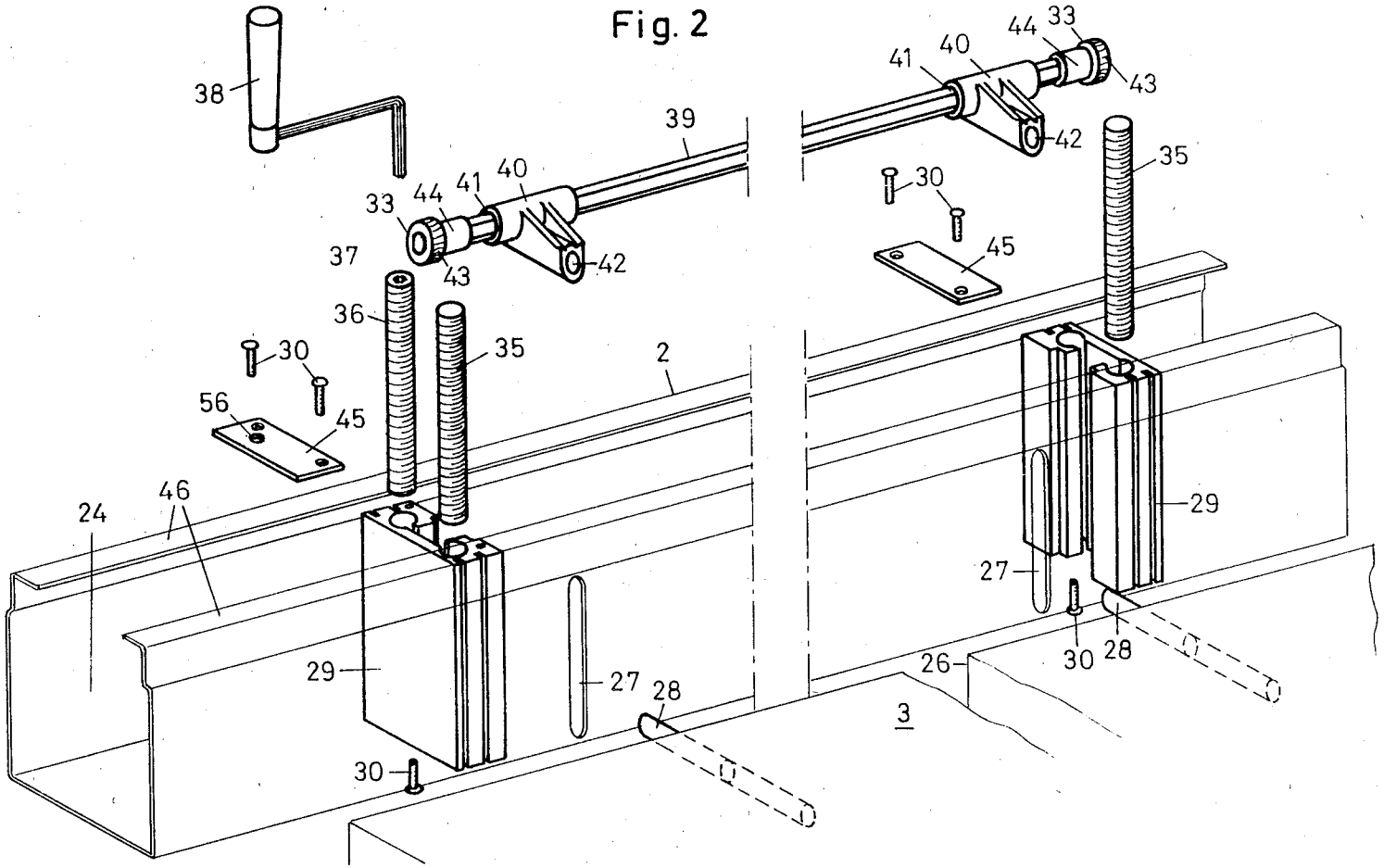
FIG. 2 shows a perspectively exploded view of the adjusting device for the rear area of the table.

The rear height-adjusting device shown in FIG. 2 exhibits two spindle guide plugs 29 which are inserted vertically and at a certain distance from each other into the inside 24 of the bracket 2 and which are locked into position at the bottom of the bracket by means of one screw 30 each. Each plug 29 has a recess for an indentation 31 which is open on one end and which extends along the length of the plug, with the margins of the indentation opening defining a guide groove 32 for the cogwheels 33. On both sides, the indentation 31 exhibits two cylindrical extensions which are designed as boreholes 34 whose purpose it is to hold the trapezoid thread spindles 35 and 36. These spindles 35, 36 rest loosely in the boreholes 34 and are freely turnable.

At the activating end (left side in FIG. 2), two parallel spindles 35 and 36 are housed in the plug 29, with one 36 of the spindles acting as the activating spindle and differing from the other spindle 35 only by the fact that it has a hexagonal hole 37 as the top into which the hexagon shaft of the crank 38 can be inserted. The plug 29 on the opposite side (right side in FIG. 2) has only one single spindle 35.

The rear activating device has a driving shaft 39 with a profile which is not circular onto which two plastic holding elements 40 with one longitudinal and one transverse boring each, 41 and 42 respectively, are pushed in such a way that they are freely turnable. Also loosely pushed onto the ends of the shaft 39 are the two cogwheels 33 which have the same internal profile as the shaft 39 and therefore fit onto the shaft 39 in such a way that they can be moved into the longitudinal direction, yet will not turn around the shaft.

The shaft 39 with the retaining elements 40 and the cogwheels 33 is inserted into the inside 24 of the bracket 2 in such a way that both cogwheels 33 run in the plugs 29. The collar 44 rests in the guide groove 32 and the teeth 43 mesh with this groove and engage the spindles 35, 36.

The activating spindle 36 and the corresponding cogwheel 33 are designed as a worm drive, with the spindle acting as the self-locking worm shaft and the cogwheel as the worm wheel. The two other spindles 35 only function as a toothed rod, however, for production reasons they are manufactured from the same rod section as the activating spindle 36.

A cover plate 45 which is fastened to the upper guide rails 46 of the bracket 2 by means of two screws 30 is used to terminate the top and as a further means for locking the plugs 29 into position. The shaft of the crank 38 can be inserted into the boring 56 in the cover plate 45.

The rear pins 28 of the table top 3 are inserted into the slits 27 of the bracket and project into the transverse borings 42 of the retaining elements 40. If the crank 38 is turned, the rear surface of the table top 3 moves up or down as can be seen from FIG. 2. Due to the self-locking worm gear, it is not possible for the table top to accidentally change position.

As can be seen from FIG. 3, essentially the same standardized components are used for the front adjusting mechanism as for the rear adjusting mechanism. This means that two guide plugs 29, three spindles, 35, 36, an activating shaft 39, two cogwheels 33, and one crank 38 are provided; in this context, it should be pointed out that in FIG. 3 the same components are designated by the same numbers as in FIG. 2.

Instead of the retaining elements 40, two tubular units 47 with a flange 48 on one end are pushed onto the shaft 39. The tubular units 47 are welded to two fastening plates 49 which are screwed to the bottom side in the front area of the table top. It is expedient if the shaft 39 is housed in a lower groove of the table top or in a transverse boring thereof. Next to the tubular units 47, the cogwheels 33 are arranged on the ends of the shaft in such a way that they cannot be turned, yet they are able to slide up and down.

Two steel section pieces 50 whose cross-section is square, are welded into the front part of each supporting arm 9; the surfaces of the steel section pieces 50 facing each other exhibit one longitudinal slit 51 each whose edges are defined by two guide rails 52. These guide rails 52 form the guides for the plugs 29 which exhibit two appropriate longitudinal grooves 53 each along the lateral surface. The plugs 29 can thus be simply inserted into the supporting arms 9 and need not be locked into position through any further devices. At the same time, the chambers for the plugs 29 which are defined by the steel section pieces 50 act as a reinforcement for the supporting arms 9 in the area in which the stress is particularly high. In the vicinity of the plug 29, the cover 6 which is manufactured from a rectangular hollow section exhibits a recess 54 as well as a welded-in supporting plate 55 which forms the upper termination of the plug 29. After introducing the spindles 35, 36 as well as the cogwheels 33 into the plugs 29, the upper covers 6 are slipped onto the supporting arms 9 where they are allowed to catch such that the plugs 29 are secured. The shaft of the crank 38 can be inserted through the opening 56.

Figure 4:
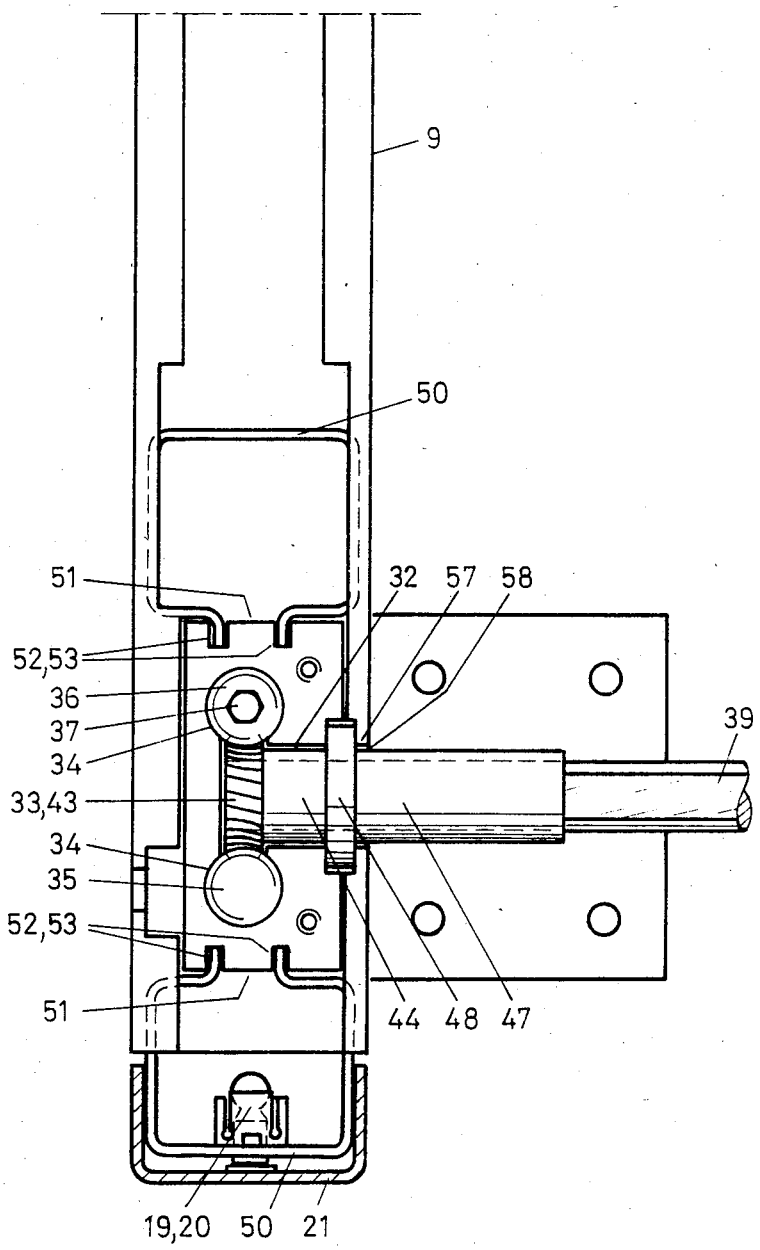
FIG. 4 shows a top view of the front area of the supporting arm with one part of the front adjusting device.

As can be seen from FIG. 4, the flange 48 of the tubular unit 47 meshes with the margins 57 of a lateral vertical slit 58 for the shaft 39. This slit 58 is arranged next to the guide groove 32 of the plug 29. This frees the front adjusting mechanism completely from any transverse stresses.

The piece of furniture described above has the following additional advantages:

The adjusting devices consist of standardized elements which ensure an economical manufacturing process. The main components are continuously manufactured as light metal or plastic extrusions and only need to be cut to the length desired. This applies in particular to the plugs 29, the thread spindles 35, 36, and the cross shafts 39.

The adjusting devices for the front and rear of the table top are for the most part made of the same components such that manufacture and storage-keeping are simplified.

The two adjusting devices can be assembled without any special tools. The front adjusting device is assembled and disassembled without any tool at all; for the rear adjusting device, only a screw driver is required in order to fasten the plugs to the bracket.

The table top as such can be inserted without tools into the stand which consists of the two side pieces and the bracket. Due to the arrangement of the four points of suspension (two in the rear and two on the sides), the static load on the table top is favorably distributed and the table top therefore is highly resistant to bending.

The two attachment elements—consisting of the plates 49 and the tubular units 47—for the shaft of the adjusting mechanism for the front keep the two side pieces at a perfect distance from each other without exerting any stress on the adjusting mechanism itself.

The activating spindle can be easily and without problem changed from left to right or vice versa. In the rear, the upper attachment plates must be loosened and exchanged and the activating spindle is inserted on the side desired. In the front, the change-over is possible without tools, with the activating spindle again being attached to the side desired and the two covers for the supporting arms being switched around.

The cover for the supporting arms 6 has several functions:

(a) It serves as the termination of the supporting arm.

(b) It secures the spindles and cogwheels in the supporting arm, and (c) it serves as an arm brace for other interlinking elements.

This piece of furniture according to this invention ensures a level of flexibility not attained so far since both the individual furniture modules as well as the standardized components of the adjusting mechanisms can be assembled and disassembled without any problems.

We claim:

1. Piece of furniture with a stand comprising two hollow side pieces (1) and a hollow bracket (2) interconnecting the two side pieces (1), and with a table top (3) which is adjustable relative to the stand in height and/or inclination by an adjusting mechanism comprising:

two identical spaced guide blocks (29) connected with the stand, the two blocks each having a vertical guide groove (32), the grooves facing each other, the guide groove (32) in each block (29) being undercut to both sides, two cogwheels (33) one each guided in a respective guide groove (32), an activating shaft (39,29) torsionally interconnecting the two cogwheels (33) and extending between the two blocks (29), a first threaded spindle (35) located in the undercut of one of the blocks (29) and meshing with the respective cogwheel (33), a second and a third threaded spindle (35,36) located in the undercut of the other block (29) on opposite sides of and meshing with the respective cogwheel (33), the third spindle (36) comprising means (37) for engagement by an activating crank (38), and two elements (40,47) rotatably mounted on the activating shaft (29,39) and connected to the table top (3).

2. Piece of furniture according to claim 1 wherein a collar (44) of each of the two cogwheels (33) is guided by the respective groove (32), the diameter of the collar (44) being smaller than the diameter of the related cogwheel (33).

3. Piece of furniture according to claim 1 wherein the two guide blocks (29) are secured inside the hollow bracket (2), the two elements being fastened to the table top (3) by pins (28) extending through vertical slots (27) of the bracket (2).

4. Piece of furniture according to claim 1, wherein two further, identical guide blocks (29) are secured adjacent to the front end of a supporting arm (9) of each side piece (1), two further cogwheels (33), interconnected by a further activating shaft (29), being guided in two vertical guide grooves (32) of the two further guide blocks (29), one of the further guide blocks (29) containing a fourth threaded spindle (35) in mesh with the respective cogwheel (33), the other block containing a fifth and a sixth threaded spindle (35,36), the sixth spindle (36) comprising means (37) for engagement by an activating crank (38), two further elements (47) rotatably supported by the further shaft (29) being connected to the front part of the table top (3).

5. Piece of furniture according to claim 4, wherein each of the further elements (47) has a radially projecting flange (48) reaching behind a vertical slot (58) of the supporting arm (9), these vertical slots (58) being aligned with the guide grooves (32) of the further guide blocks (29).

6. Piece of furniutre according to claim 1, wherein the spindles (35,36) are loosely inserted in the respective guide blocks (29) and are axially held in place by covers (6,45) secured to the guide blocks (29).

* * * * *